United States Patent [19]

Okamura et al.

[11] 3,980,841

[45] Sept. 14, 1976

[54] SPEAKER EDGE

[75] Inventors: Hiroshi Okamura; Hisao Sato, both of Tokyo; Isamu Iwasaki, Yono, all of Japan

[73] Assignees: K.K. Fujita Shoten; Hisao Sato, both of Tokyo, Japan

[22] Filed: May 23, 1975

[21] Appl. No.: 580,524

[52] U.S. Cl. ..... 179/181 R; 181/172

[51] Int. Cl.[2] ..... H04R 7/12

[58] Field of Search ..... 179/181 R; 181/172, 181/171

[56] References Cited

UNITED STATES PATENTS 3,858,680 1/1975 Tsuge et al. ..... 181/172

3,905,448 9/1975 Kawakami et al. ..... 181/172

*Primary Examiner*—Thomas W. Brown

*Attorney, Agent, or Firm*—Oblon, Fisher, Spivak, McClelland & Maier

[57] ABSTRACT

An acoustic material suitable for use as a speaker edge comprises an expanded plastic and minute collagen fibers wherein the content of the collagen fibers is 15 – 40% based on the weight of the expanded plastic and the length of the fibers is equal to or less than 1 mm.

12 Claims, 9 Drawing Figures

SPEAKER EDGE

BACKGROUND OF THE INVENTION

1. Field of the Invention

The present invention relates generally to the composition of an acoustic element of a speaker and more particularly to a speaker edge which is capable of lowering the lowest resonance frequency, $f_0$ of the speaker and of maintaining relatively stabilized sound characteristics of the speaker during variations of temperature and humidity.

2. Description of the Prior Art

In conventional cone type speakers, the speaker edges have been made of such materials as cotton fabrics, rubber sponges and foamed urethane resins. When cotton fabrics are used, the speaker edges have to be coated with an agent of high viscosity, generally known as a "vis-colloid". As a result, the characteristics of the speaker edges are greatly influenced by variations of temperature. When rubber sponges are used, it is difficult to produce edges having uniform characteristics because they are foamed from sheet materials. Finally, when speaker edges are made of foamed urethane, they are significantly affected by variations in humidity.

In order to overcome the above defects, extensive studies and experiments have been performed on new speaker edges and cone edges — elements of a speaker which have a significant and delicate influence upon the overall sound characteristics. These efforts have centered on the use of expanded plastics obtained from ethylene copolymers, such as ethylene/vinyl acetate copolymer (EVA) and ethylene/ethyl acrylate copolymer (EEA), for example, because these materials are superior in strength and exhibit excellent flexibility at low temperatures and low brittle-point temperatures without the use of any platicizers. According to the results from these experiments, the characteristics of speaker edges formed from foamed EVA are somewhat improved over those of the conventional cotton cloth speaker edges at lower temperatures. However, the cotton cloth speaker edge is superior as a whole in other respects. It is expected that the internal loss of sound within the foamed plastic is excessive because of the use of the foamed plastic alone.

Consequently, it would be most desirable to have a speaker edge which is insensitive to changes in temperature or humidity while at the same time is capable of producing sound with high quality, uniform characteristics.

SUMMARY OF THE INVENTION

Accordingly, it is an object of the present invention to provide a speaker edge which is superior in its insensitivity to temperature variations and which produces low frequency sound characteristics of high quality, particularly at low temperatures.

It is another object of the present invention to provide a speaker edge which is insensitive to humidity variations and is lightweight while having suitable resiliency and excellent shape preservation characteristics.

It is still another object of the present invention to provide a speaker edge having uniform characteristics which can be molded easily on a mass production basis.

It is yet another object of the present invention to provide a speaker edge which is capable of minimizing the deleterious effects of vibrations generated by the magnet in the speaker by enabling the use of a smaller magnet.

Briefly, these and other objects of this invention, as will hereinafter be made clear by the ensuing discussion, have been attained by providing an acoustic composition suitable for use as a speaker edge consisting essentially of an expanded plastic, preferably a copolymer of ethylene, most preferably ethylene/vinyl acetate copolymer (content of VA, 10-40%) (hereinafter referred to as EVA) and minute collagen fibers.

BRIEF DESCRIPTION OF THE DRAWINGS

Various other objects, features and attendant advantages of the present invention will be more fully appreciated as the same become better understood by reference to the following detailed description when considered in connection with the accompanying drawings, wherein.

DESCRIPTION OF THE PREFERRED EMBODIMENTS

The present invention makes it possible to significantly improve the internal loss, transmission and reflection characteristics of the sound in a speaker edge by compounding chrome collagen short fibers obtained from leather shaving dusts within a foamed matrix of EVA so that the cells formed in the matrix are connected by the collagen fibers which absorb vibrations.

The collagen fibers are considered to be bundles of animal protein fine fibers. Each fiber has nodes spaced apart at a particular distance. Voids are formed between each of the fibers. Accordingly, if each of the cells in the foamed matrix is connected by the collagen fibers, the matrix is locally constituted of open cells which are somewhat different from normal, simple open cells since they are macroscopically connected by sheaths having no internal voids and are externally impervious to air.

The speaker edge according to the present invention is produced by the steps of mixing 15–40 wt% of the minute collagen fibers with EVA, foaming the mixed materials into the shape of a board such that the final product has 2 to 8 times the volume of the starting materials and slicing the board into sheets of a predetermined thickness. Then, each of the sheets is passed through a furnace at a temperature of from 100° – 110°C in order to effect natural thermal shrinkage in all directions. Immediately after the thermal treatment, the speaker edge is molded by a heat die with a temperature lower than that of the furnace. The final product is obtained after cooling by punching the sheet into a predetermined shape (e.g., an annular shape), either at the same time of or after the molding operation.

Chrome collagen fibers are considered to be the best collagen fibers for use in this invention from the viewpoint of heat resistance and processing features. The length of the fibers should not be more than 1 mm in order to minimize the rates of thermal shrinkage during molding to improve the shape preservation characteristics and to unify the directional characteristics of the absorption of vibration. If the mixing ratio of the amount of collagen fibers to that of EVA is less than 15% by weight, the edge is liable to be deformed by heat during the thermal adhesion of the edge to the speaker cone and frame. If the ratio exceeds 40%, the edge becomes hardened and $f_o$ is increased. If the volume ratio employed in the foaming of the materials is less than 2, the surface strength of the edge is increased but the total weight is almost the same as that of the conventional cotton cloth edge. This is undesirable. When the foaming ratio is greater than 8, the edge becomes too resilient and flexible. This results in severe distortion of tone quality and the product is useless as a speaker edge. The magnitude of the volume ratio employed in the foaming of the material is preferably from 4–6 in view of the procurement of the most desirable acoustic characteristics.

Figure 1:
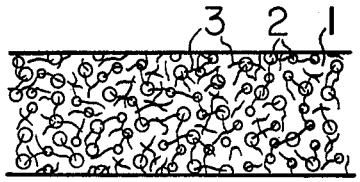
FIG. 1 is a schematic enlarged sectional view of a speaker edge in accordance with the present invention.

Referring now to the drawings, and more particularly to FIG. 1, the speaker edge shown comprises a foamed matrix 1 of EVA, cells 2 and chrome collagen short fibers 3. The chrome collagen short fibers 3 have a mesh of from 0.3 × 0.3 m/m – 0.5 × 0.5 m/m and are prepared by mixing from 5 – 20% of dechromed leather shaving dusts with chrome shaving dusts and forming the mixture into a board-like configuration. The collagen fibers acts as an adhesive agent forming a hard mass by gelatinizing parts of the dechromed shaving dusts. The mass is then dried and cut. Obviously, ordinary chrome collagen fibers may be used in this invention.

The speaker edge 5 (FIG. 4) may take any suitable shape, such as semi-circular or that of a peak. Since it is impossible to use an organic adhesive agent for the edge 5 of the present invention, a laminated portion or overlapping width 9 of the edge 5 is preferably adhered to the cone 6 by a water soluble thermal adhesive agent. The outer periphery of the edge 5 is preferably adhered to the frame 8 by means of ring paper 10 when an organic adhesive agent is used.

Having generally described the invention, a more complete understanding can be obtained by reference to a certain specific example, which is included for purposes of illustration only and is not intended to be limiting unless otherwise specified.

EXAMPLE

| | |
|---|---|
| EVA (Mitsubishi Petrochemical Co., Ltd.) | 100 parts |
| Synthetic rubber ("Hiker" - trademark) | 10 parts |
| Stearin | 1 part |
| Peroxide | 1 part |
| Inorganic foaming agent | 3 parts |
| Pigment | 3 parts |

22 parts of collagen fibers (0.2 to 0.3 mm in length) are mixed with the above composition (M) and the mixture is expanded with a foaming volumetric ratio of 5 at a temperature of 170°C after sufficient kneading.

A sponge-like sheet of 15 mm thickness is obtained and sliced into sheets of 0.5 mm thickness. It should be noted that the foaming volumetric ratio of the compounds is slightly lower than that of the compositions not containing the collagen fibers because some of the gases decomposed from the foaming agent are absorbed into the collagen fibers. It is apparent that the flexibility of the product may be changed in accordance with the number of foamed cells incorporated in the substance.

Figure 2:
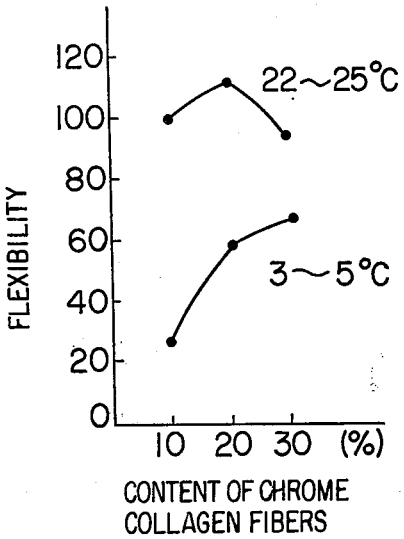
FIG. 2 is a graph showing the relation between flexibility and content of chrome collagen fibers.
Figure 3:
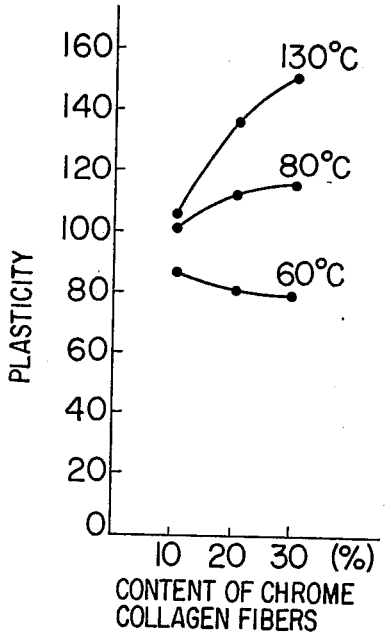
FIG. 3 is a graph showing relation between plasticity and content of the chrome collagen fibers.

Results of an experiment measuring the relationship between the flexibility and plasticity of the edge materials (A) and the content of collagen fibers are shown in FIGS. 2 and 3, respectively. It can be recognized that the variation in the flexibility of the product is quite acceptable if the collagen fiber content is more than 5%. Also, no hardening occurs at the lower temperatures of 3° – 5°C if the collagen fiber content is more than 20%, although a thermo-plastic synthetic resin such as EVA is generally hardened at the lower temperature. FIG. 2 also shows the flexibility of an EVA sheet containing no collagen fibers at a temperature of 22° – 25°C measured by the Gurley method (Japanese Industrial Standard L 1079) as a standard, i.e., 100. It can also be recognized that the plasticity of the material containing the collagen fibers is inferior to that of the composition (M) at the temperature of 60°C, while it is superior to it at the temperature above 80°C. FIG. 3 also shows the plasticity of a sheet containing no collagen fibers at a temperature of 80°C which was kept at this fixed temperature for five hours and was measured in accordance with Japanese Industrial Standard K 6546, using a standard of 100. Each curve of this Figure shows a value measured after the materials were maintained for 48 hours at a temperature of 25°C under 90% relative humidity.

The sheet for a speaker edge made as illustrated above is heated to 80° – 90°C for 2 – 3 seconds in a die for producing annular edge members (3 cm in width and 0.5 mm in thickness). The cross-section is semi-circular and has the same diameter as that of conventional speaker edges so as to be adaptable to a cone speaker of 30 cm in diameter. Immediately after the heating operation, the sheet is cooled to a temperature below 10°C. The amount of time required in this molding process is extremely short; that is, approximately 15 seconds per edge.

Figure 4:
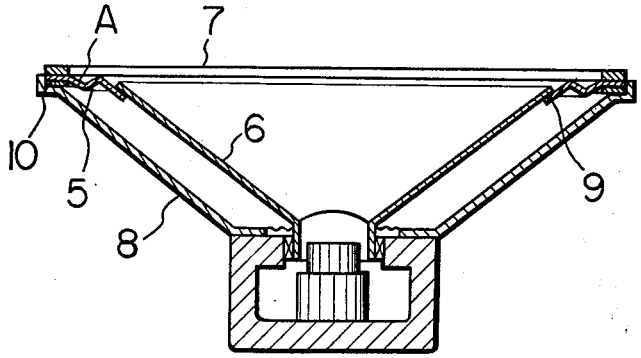
FIG. 4 is a sectional view of a speaker edge showing the manner of fixing it to a speaker.

Sound characteristics are measured by Brüel and Kjoer's automatic frequency response recorder on a speaker of 30 cm diameter using the speaker edge (A) produced in accordance with the foregoing process and a speaker (B) as shown in FIG. 4 having a conventional cotton cloth edge treated with phenol resin and coated with viscolloid. These two speakers are identical except for the speaker edges.

Figure 5:
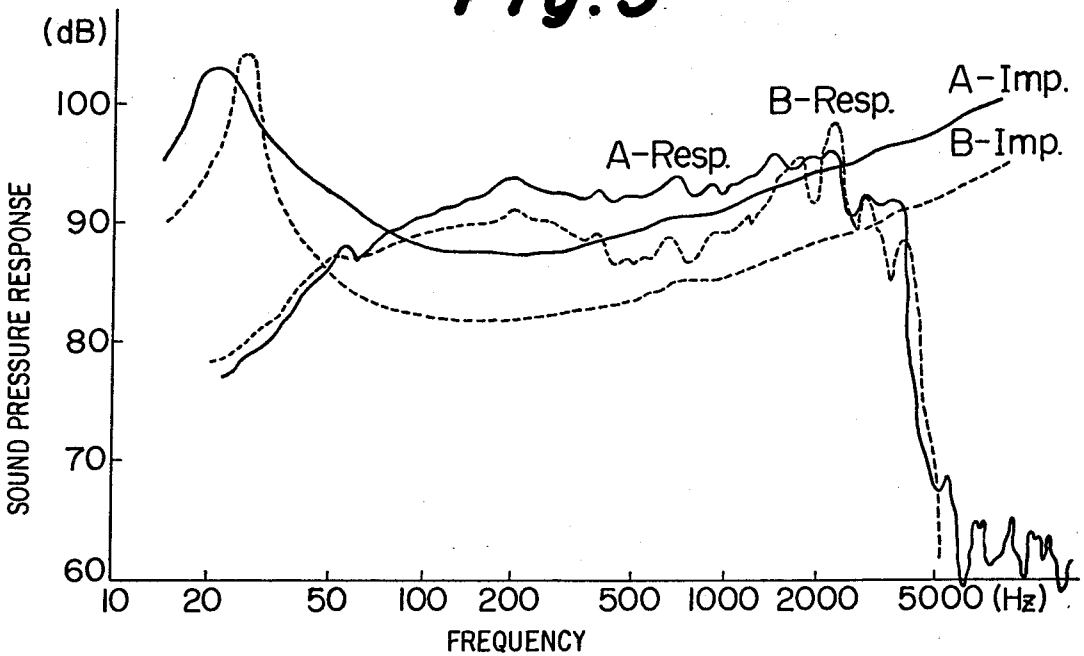
FIG. 5 is a graph showing the frequency characteristics of the electrical impedance and the sound pressure response of a speaker according to the present invention as compared with a conventional speaker.

FIG. 5 shows a comparison between the frequency characteristics of the electric impedance and the output sound pressure response of the speakers. As is apparent from FIG. 5, the speaker having the edge (A) in accordance with the present invention has a peak of impedance at 20 Hz and the frequency of the peak, namely the lowest resonance frequency, $f_o$, is lower than that of a conventional speaker using the cotton cloth edge. This indicates that the speaker according to the present invention has a wider sound reproduction range in the low sound region, as compared with the speaker using the cotton cloth edge. Furthermore, it can be recognized that the fall-off of the curve from its peak in the edge (A) is more gentle than that of the speaker (B), and that the Q factor ($Q_o$) of the edge (A) is smaller than that of the speaker B. This indicates that the sound reproduction in the lower sound region is uniform and that the tone quality is superior. The Q factor is physically defined as the reciprocal of the ratio of energy loss to the total energy of vibration per one cycle. Thus, when the Q is smaller, it signifies a greater energy loss, i.e., a greater internal loss, in the edge. It is assumed that this is due to the absorption of the vibration by the collagen fibers and the communication of the cells as hereinbefore described.

Referring now to the characteristics of the speaker in the medium sound region in connection with the sound pressure response curve shown in FIG. 5, it can be recognized that the irregularities of the curve near the frequency of 500 Hz in the edge (A) are less severe than in the speaker B. This indicates that the antiresonance is weak because of the reverse phased vibration of the edge and cone, and that the sound distortion in the medium and high sound regions is less severe.

Figure 6:
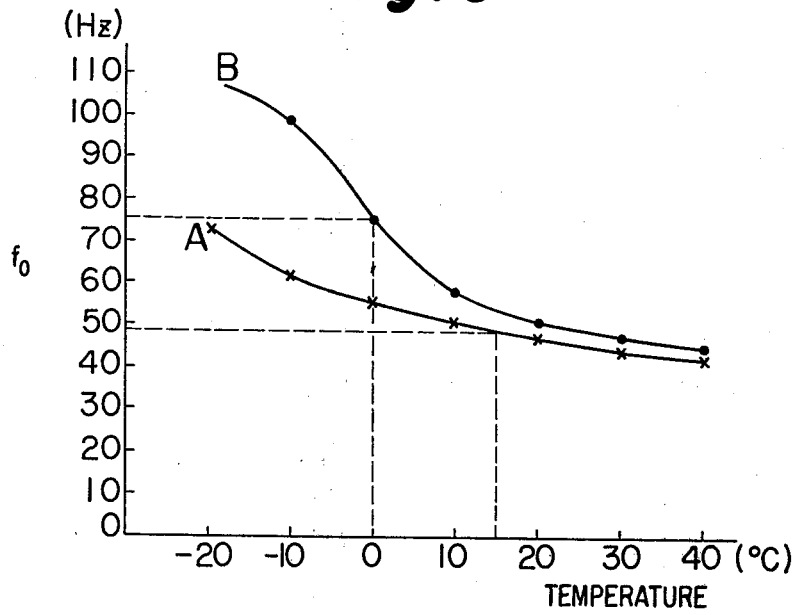
FIG. 6 is a graph showing the variation of $f_0$ as a function of temperature.

FIG. 6 illustrates the results of experiment on the variation of $f_o$ of the edge of the present invention as a function of temperature change. The temperatures at which the speaker is used are approximately within 5° – 30°C. As is apparent from FIG. 5, $f_o$ in the conventional speaker B increases abruptly at a temperature below 15°C. This means that there is a remarkable difference in the tone quality of the conventional speaker in summer and winter. To the contrary, $f_o$ of the speaker using the edge of the present invention varies only a small amount and substantially uniform tone quality can be maintained throughout the year.

Figure 7:
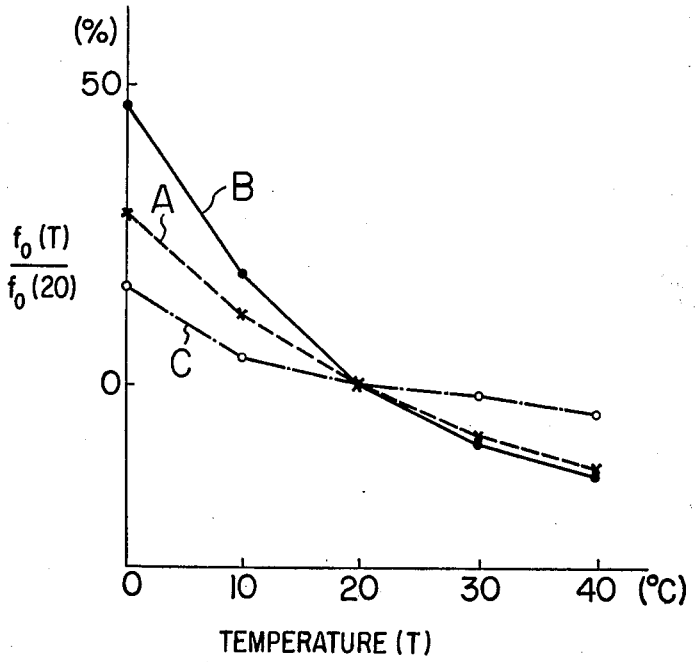
FIG. 7 is a graph showing the variation of the ratio of $f_0$ to $f_0$ at 20°C as a function of temperature.
Figure 8:
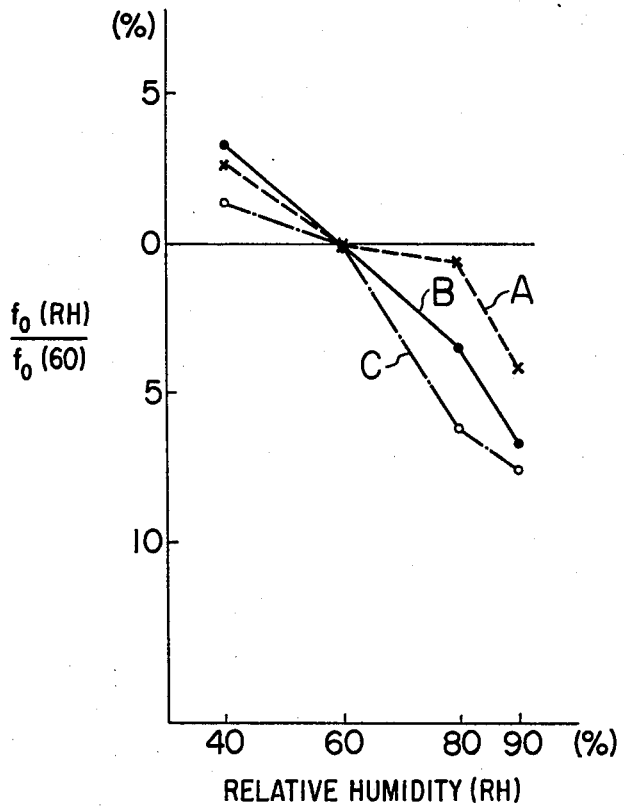
FIGS. 8 and 9 are graphs showing the variation of the ratio of $f_0$ to $f_0$ at 60% relative humidity as a function of relative humidity, at constant temperature.
Figure 9:
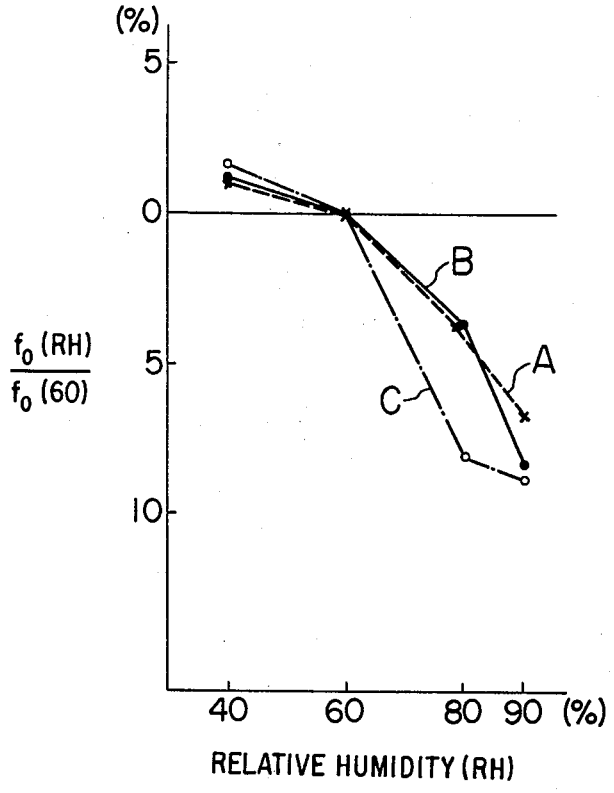

Variation rates of $f_o$ with changing temperature are shown in FIG. 7. This graph shows how $f_o$ of each of the speakers varies as a function of temperature relative to $f_o$ of each of the speakers at 20°C. The curve C represents the variation rate of $f_o$ of a commercially available 30 cm speaker using a urethane sponge edge. The variation rate of $f_o$ as a function of temperature is superior to that of the speaker using the edge A of the present invention. Similar variation rates of $f_o$ as a function of changing humidity are however, shown in FIGS. 8 and 9. The $f_o$ of the urethane sponge edge is greatly affected by variations in humidity and its variation rate tends to be larger as the temperature increases. (The temperature for FIG. 9 is greater than that for FIG. 8.)

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. An acoustic material suitable for use as a speaker edge comprising an expanded plastic and minute collagen fibers wherein the content of the collagen fibers is 25 – 40% based on the weight of the expanded plastic, and the length of the fibers is equal to or less than 1 mm.

2. The acoustic material of claim 1, wherein the expanded plastic is an ethylene copolymer.

3. The acoustic material of claim 2, wherein the ethylene copolymer is ethylene/vinyl acetate copolymer.

4. The acoustic material of claim 1, wherein the collagen fibers are prepared by mixing dechromed leather shaving dust with chrome shaving dust.

5. The acoustic material of claim 4, wherein the content of the dechromed shaving dust is 5–20%, based on the weight of the chrome shaving dust.

6. A speaker edge which is formed from an acoustic material which comprises an expanded plastic and minute collagen fibers wherein the content of the collagen fibers is 15–40% based on the weight of the expanded plastic, and the length of the fibers is equal to or less than 1 mm.

7. The speaker edge of claim 6, wherein the expanded plastic is an ethylene copolymer.

8. The speaker edge of claim 6, wherein the ethylene copolymer is ethylene/vinyl acetate copolymer.

9. A method of preparing a speaker edge which comprises forming a mixture which comprises an expanded plastic and minute collagen fibers wherein the content of the collagen fibers is 15–40% based on the weight of the expanded plastic, and the length of the fibers is equal to or less than 1 mm, further comprising the steps of forming the resultant mixture into the shape of a board, slicing the board into sheets, passing the sheets through a furnace so as to cause thermal shrinkage in all directions, molding the thermally treated sheets with a heat die, and punching the molded sheets into predetermined shapes.

10. The method of claim 9, wherein the mixture of the collagen fibers and expanded plastic is foamed to a value 2–8 times that of its original volume.

11. The method of claim 9, wherein the thermal treatment in the furnace is carried out at 100°–110°C.

12. The method of claim 9, wherein the molding operation by the heat die is carried out at a temperature lower than that used in the furnace treatment.

* * * * *